US006843738B2

(12) United States Patent
Spencer

(10) Patent No.: US 6,843,738 B2
(45) Date of Patent: Jan. 18, 2005

(54) SHARP SHOOTER BASKETBALL APPARATUS

(76) Inventor: Gregory P. Spencer, 243 Kedzie St., East Lansing, MI (US) 48823

( * ) Notice: Subject to any disclaimer, the term of this patent is extended or adjusted under 35 U.S.C. 154(b) by 0 days.

(21) Appl. No.: 10/824,212

(22) Filed: Apr. 14, 2004

(65) Prior Publication Data

US 2004/0192476 A1 Sep. 30, 2004

Related U.S. Application Data

(62) Division of application No. 10/131,811, filed on Apr. 25, 2002, now Pat. No. 6,758,768.

(51) Int. Cl.[7] ..... A63B 63/00; A63B 63/08

(52) U.S. Cl. ..... 473/472; 473/448; 473/481

(58) Field of Search ..... 473/481, 472, 473/448, 480, 435, 479, 431, 412, 447, 415; 273/317; 40/794, 572, 546, 437; 221/305

(56) References Cited

U.S. PATENT DOCUMENTS

| | | | |
|---|---|---|---|
| 1,843,980 | A | 2/1932 | Hotchner |
| 2,499,824 | A | 3/1950 | Haecker |
| 3,137,502 | A | 6/1964 | Duganich |
| 3,561,762 | A | 2/1971 | Russell |
| 3,825,257 | A | 7/1974 | Palmer |
| 3,856,303 | A | 12/1974 | Payne, Jr. et al. |
| 4,285,518 | A | 8/1981 | Pearo |
| 4,468,027 | A | 8/1984 | Pangburn |
| 4,588,188 | A | 5/1986 | Mahoney et al. |
| 4,895,365 | A | 1/1990 | Schroeder |
| 5,224,699 | A | 7/1993 | Zaruba |
| 5,695,415 | A | 12/1997 | Docherty et al. |
| 5,800,290 | A | 9/1998 | Barry |
| 6,398,673 | B1 | 6/2002 | Maruca |
| 6,554,724 | B2 | 4/2003 | Taylor |

*Primary Examiner*—Gregory Vidovich
*Assistant Examiner*—M. Chambers
(74) *Attorney, Agent, or Firm*—Knechtel, Demeur & Samlan

(57) ABSTRACT

A basketball apparatus is provided that teaches basketball players to make the perfect basketball shot when shooting backboard shots from any location on the basketball court. The basketball apparatus consists of a backboard, a basketball hoop, a supporting bracket located in front of the backboard providing a reflective surface, and a member attached to the supporting bracket and having a target affixed thereon. The member and the supporting bracket coacting to reflect the target and produce a reflective target bulls eye. Upon shooting, if the user aims towards the centerpoint of the reflective target bulls eye and shoots the basketball in the proper trajectory to engage that centerpoint, the basketball, on this trajectory toward the centerpoint, would engage the backboard at a perfect reflection point and, thereby, bounce off the backboard towards the basketball hoop to obtain the perfect basketball shot.

7 Claims, 6 Drawing Sheets

SHARP SHOOTER BASKETBALL APPARATUS

I. RELATED PATENT APPLICATION

This patent application is a divisional of prior U.S. patent application Ser. No. 10/131,811, filed Apr. 25, 2002, now U.S. Pat. No. 6,758,768.

II. FIELD OF THE INVENTION

The present invention relates to basketball apparatus and, more particularly, to a basketball apparatus that teaches basketball players to improve their shooting accuracy when shooting backboard shots from any location on the basketball court.

III. DESCRIPTION OF THE PRIOR ART

In the game of basketball, the coaches spend a great deal of time contemplating the talents and dichotomy of the players to assemble a good team, game plans specifically tailored toward capitalizing on the strengths of these players, and strategies to execute these game plans depending upon the opponent. All this effort is exerted to produce a winning team. However, this effort becomes futile and, winning impossible, if the players do not execute their shots with accuracy and, thereby, score points for the team.

A good basketball player will spend, either under his or her own initiative or under the coach's direction, a great deal of time practicing shooting. During practicing, the player will repeatedly shoot from the same location on the basketball court until he or she begin to continually make the shot from this location. The player may shoot the basketball directly into the basketball hoop or shoot the basketball to an area on the backboard such that the basketball will bank off the backboard into the basketball hoop. In either instance, the basketball player will shoot the shot from this location until the player is comfortable with the amount of energy to initiate the shot and is assured of the trajectory and aim that will achieve a successful shot. In fact, U.S. Pat. No. 3,825,257 to Palmer entitled "Apparatus For Practicing Basketball Throws" is an apparatus that a basketball player can use to practice this same shooting technique when the player is unable to do so on the actual basketball court. The problem with this practicing philosophy and the patent is that there is no discernable method, other than by trial and error, by which to train a player to shoot a successful shot from this location or from any other location on the basketball court. Regardless of the location on the basketball court, there are an infinite number of trajectories and speeds that the basketball may travel to make a basketball shot. For each location, this trajectory and speed of the basketball may be directed straight into the basketball hoop or bounced off the backboard into the basketball hoop. For basketball shots bounced off the backboard, there is a correct location on the backboard which will produce a perfect, successful shot given each location, trajectory, and speed. With any variation from that correct location on the backboard, the shot will not be a perfect shot but may or may not be a success if: (1) the basketball barely missed hitting the basketball rim and entered the basketball hoop to score points, or (2) the basketball hit the basketball rim and entered into the basketball hoop to score points, or (3) the basketball hit the basketball rim and did not enter into the basketball hoop, thereby, not scoring points, or (4) the shot may completely miss the basketball hoop altogether, resulting in what is commonly termed an "air ball" shot. Thus, there is a need and there has never been disclosed a target bulls eye which will eliminate the guessing associated with making successful backboard basketball shots from anywhere on the basketball court.

IV. OBJECTS OF THE INVENTION

It is the primary object of the present invention to provide a basketball apparatus that teaches basketball players to improve their shooting accuracy when shooting backboard shots. A related object of the present invention is to teach basketball players this improvement of shooting accuracy from any location on the basketball court.

Another object of the present invention is to provide a basketball apparatus that is equally useful for basketball players of all heights.

Another object of the present invention is to provide a basketball apparatus that is light weight and portable.

Still another related object of the present invention is to provide a quality basketball apparatus that is inexpensive to manufacture.

Another object of the invention is to provide a basketball apparatus that is safe and easy to use.

Other objects of the present invention will become more apparent to persons having ordinary skill in the art to which the present invention pertains from the following description taken in conjunction with the accompanying drawings.

V. SUMMARY OF THE INVENTION

The present invention is a basketball apparatus that provides a target bulls eye to teach basketball players to make the perfect basketball shot when shooting backboard shots from any location on the basketball court. The basketball apparatus consists of a backboard, a basketball hoop, a supporting bracket located in front of the backboard providing a reflective surface, and a member attached to the supporting bracket and having a target affixed thereon. The member and the supporting bracket coacting to reflect the target and produce a reflective target bulls eye. Upon shooting, if the user aims towards the centerpoint of the reflective target bulls eye and shoots the basketball in the proper trajectory to engage that centerpoint, the basketball, on this trajectory toward the centerpoint, would engage the backboard at a perfect reflection point and, thereby, bounce off the backboard towards the basketball hoop to obtain the perfect basketball shot.

VI. BRIEF DESCRIPTION OF THE DRAWINGS

The Description of the Preferred Embodiment will be better understood with reference to the following figures.

Figure 2:
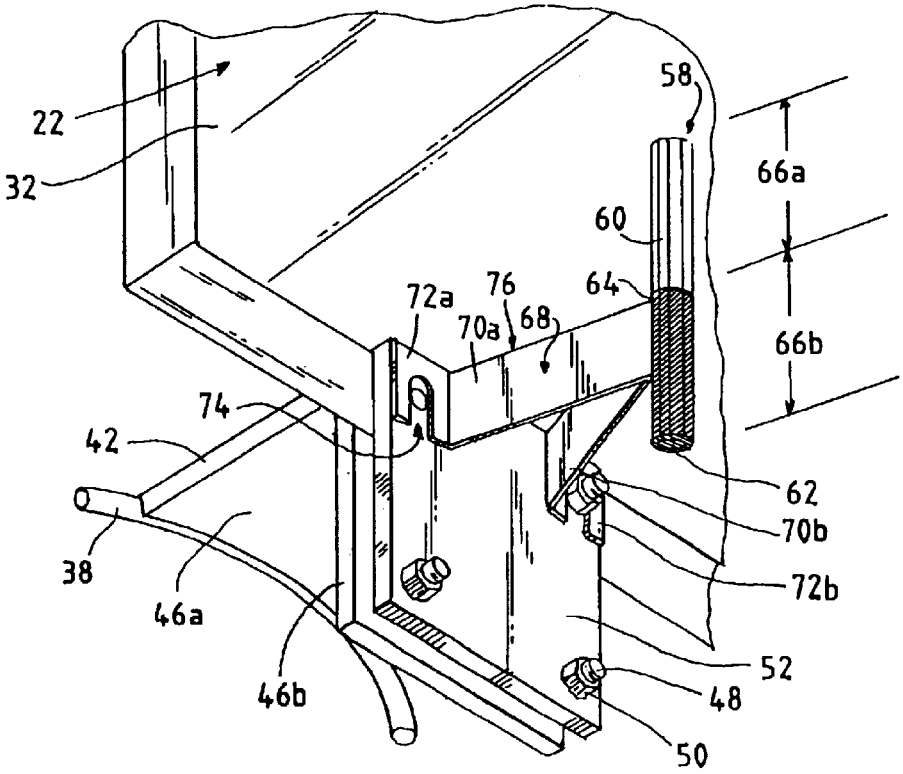
FIG. 2 is a perspective view, with portions removed, illustrating the target bulls eye with respect to the basketball apparatus.
Figure 2A:
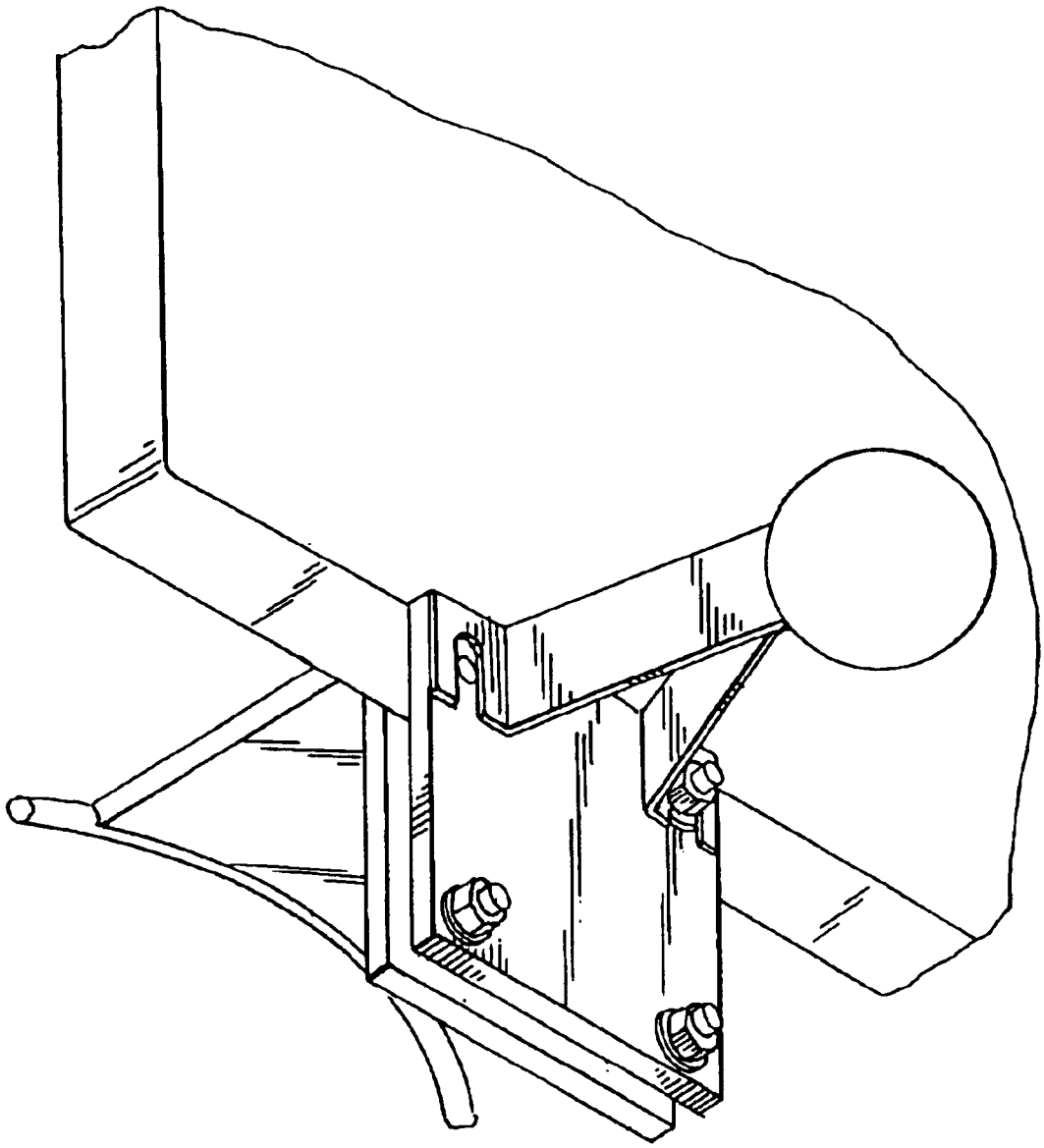

FIG. 2*a* is a perspective view, with portions removed, illustrating an alternate embodiment of the target bulls eye with respect to the basketball apparatus.

Figure 3:
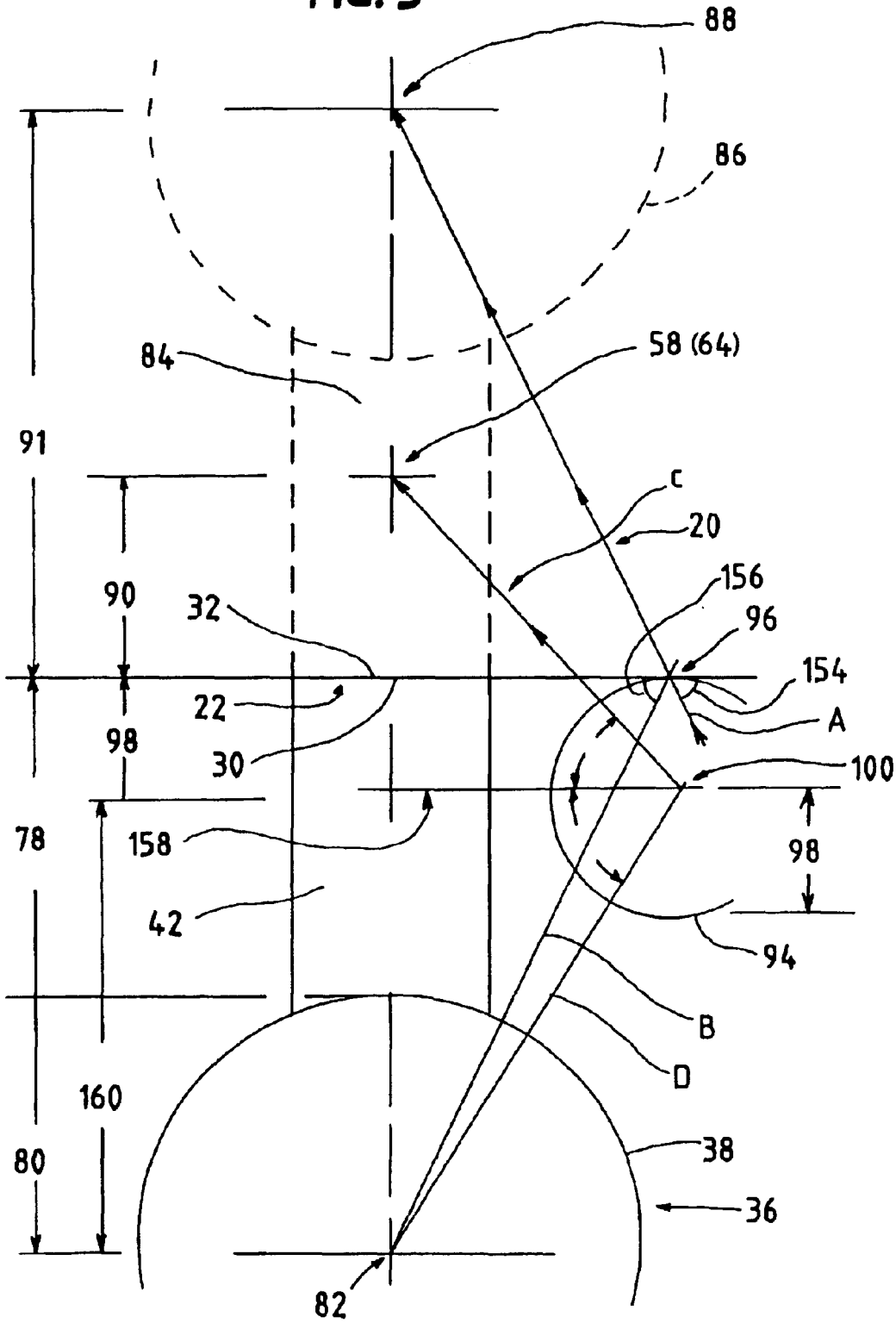

FIG. 3 is a top plan view, with portions removed, illustrating the location of the centerpoint of the target bulls eye on the basketball apparatus.

Figure 4:
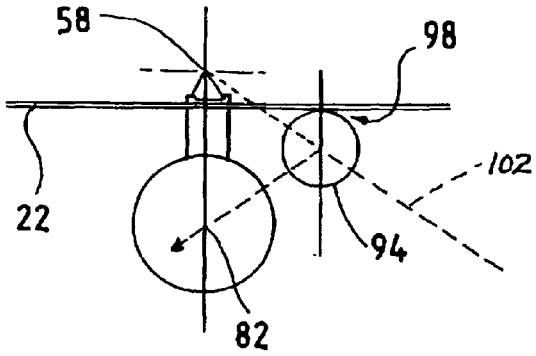

FIG. 4 is a top plan view, with portions removed, illustrating the use of the target bulls eye in relation to the trajectory of a basketball shot with respect to the basketball apparatus.

Figure 5:
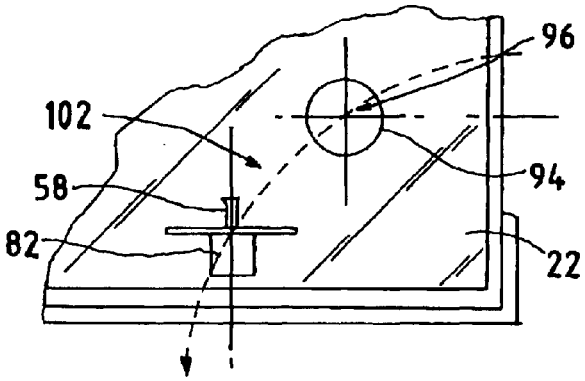

FIG. 5 is a front elevation view, with portions removed, illustrating the use of the target bulls eye in relation to the trajectory of a basketball shot with respect to the basketball apparatus.

Figure 6:
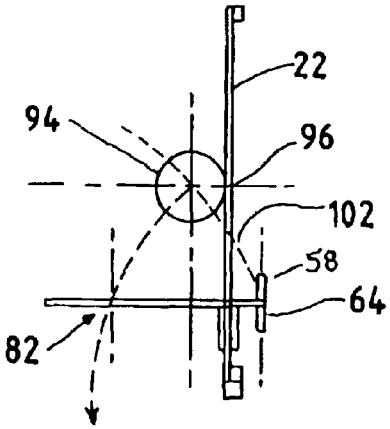

FIG. 6 is a side view, with portions removed, illustrating the use of the target bulls eye in relation to the trajectory of a basketball shot with respect to the basketball apparatus.

Figure 7:
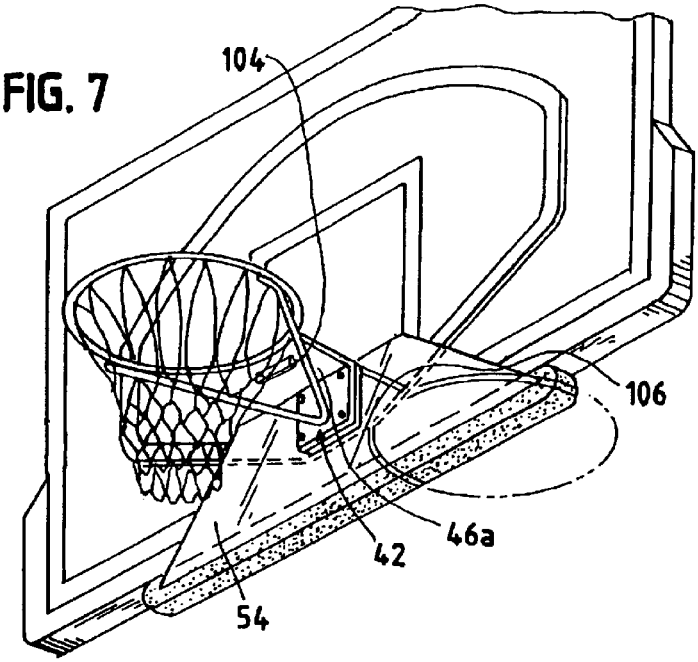

FIG. 7 is a perspective view of an alternate embodiment of the basketball apparatus.

Figure 8:
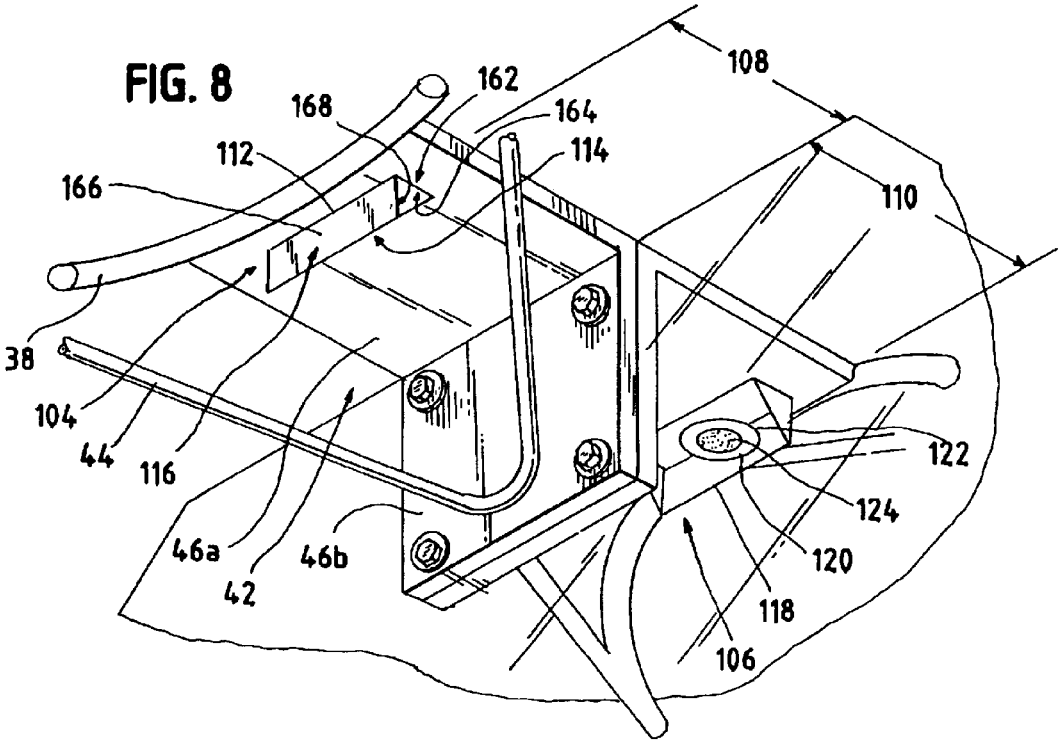

FIG. 8 is an enlarged perspective view, with portions removed, illustrating the alternate embodiment of the reflective target bulls eye with respect to the basketball apparatus.

Figure 9:
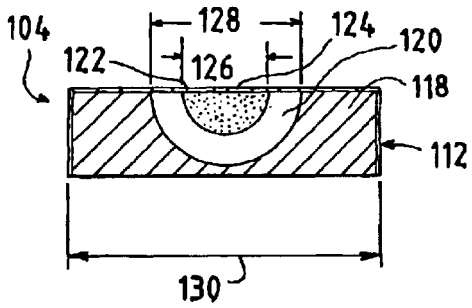

FIG. 9 is a bottom view of the L-shaped member used in the alternate embodiment illustrating the sections that form the reflective target bulls eye.

Figure 10:
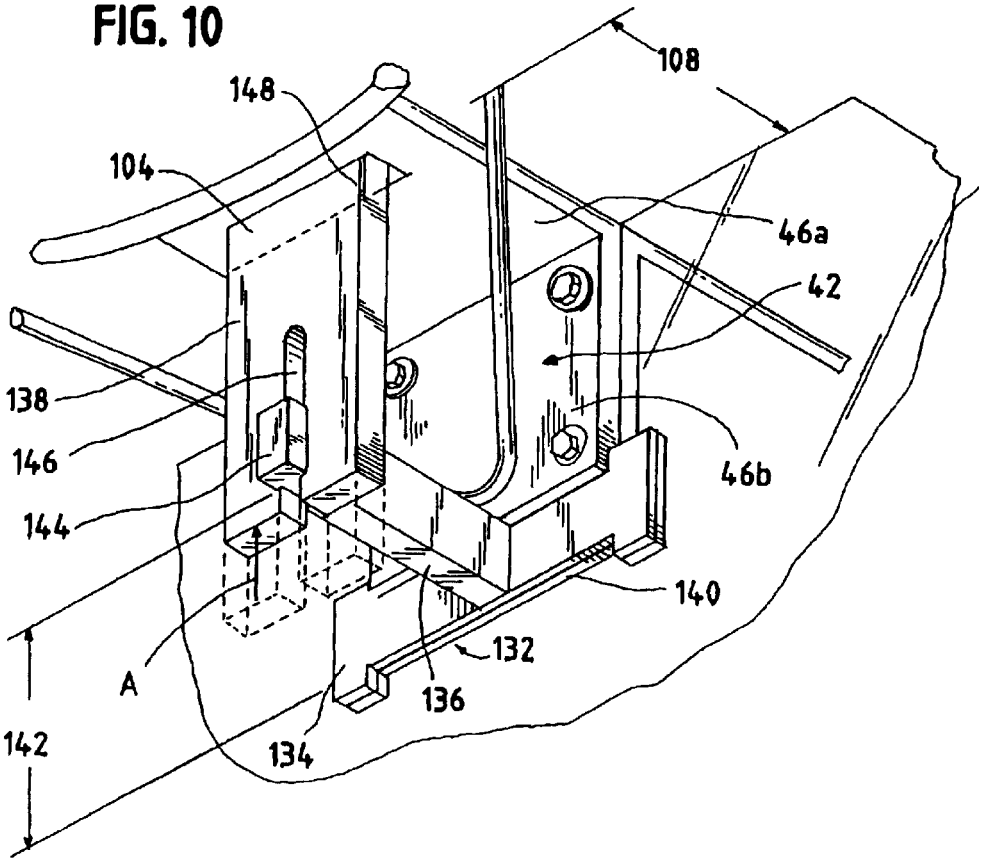

FIG. 10 is an enlarged perspective view, with portions removed, of the alternate embodiment illustrating the guide template to place the L-shaped member into proper position.

Figure 11:
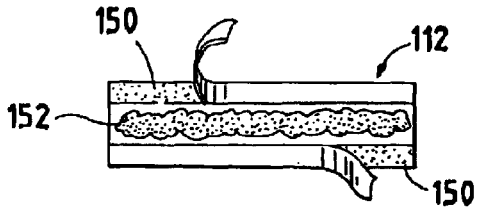

FIG. 11 is a top planar view of the L-shaped member used in the alternate embodiment illustrating the sticky substance or bonding agents to adhere the L-shaped member in proper position to achieve the reflective target bulls eye.

VII. DETAILED DESCRIPTION OF THE PREFERRED EMBODIMENT

Figure 1:
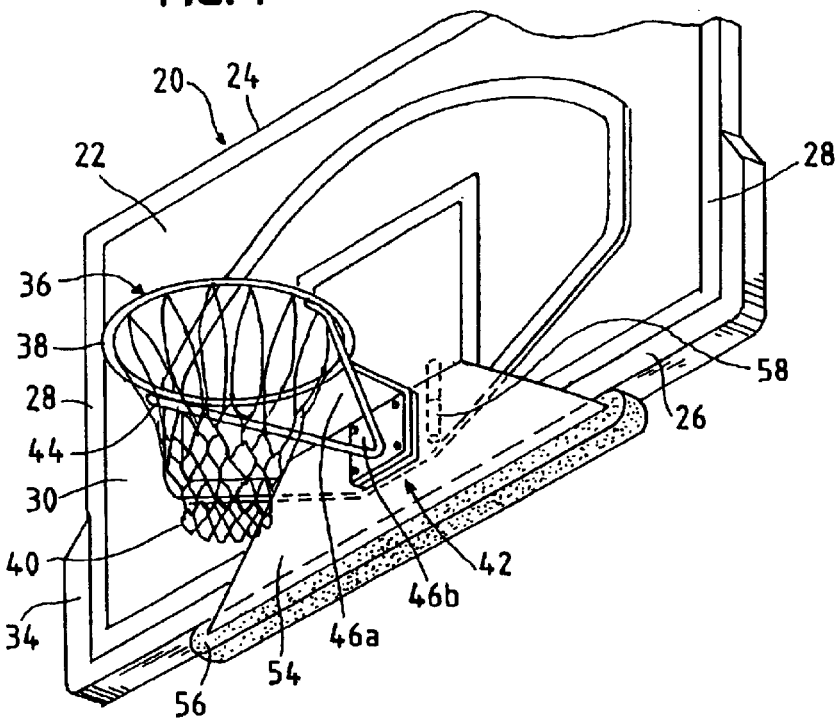
FIG. 1 is a perspective view of the basketball apparatus.

Turning first to FIG. 1, there is illustrated a basketball apparatus 20. The basketball apparatus 20 has a backboard 22. As illustrated in a non-limiting example, the backboard 22 is rectangular in shape. Alternatively, the backboard 22 could be any other shape including but not limited to, oval, pentagon, hexagon, etc . . . provided that the shape continues to act as a backboard for the basketball apparatus 20 in the manner discussed below. In the preferred embodiment, the backboard 22 is made of a durable, transparent glass or clear acrylic or plastic. Alternatively, in an alternate embodiment, the backboard 22 can be made of non-transparent material. The backboard 22 has a top 24, bottom 26, sides 28, front 30, and back 32 (FIG. 2). Situated along the bottom 26 and the sides 28 is a cover 34. Preferably, the cover 34 is made of a durable rubber to prevent a basketball player from being injured on the backboard 22.

Centered along the bottom 26 of the backboard 22 is a basketball hoop 36. The basketball hoop 36 consists of a basketball rim 38, a basketball net 40, a supporting bracket 42, and a rim support 44. In the preferred embodiment, the basketball rim 38 is positioned perpendicular to the backboard 22. The use of the basketball net 40 is threefold: (1) to catch the basketball that enters through the basketball rim 38; (2) to aid as a signal that points have been scored by the offensive team; and (3) prevent injury to basketball players under the basketball hoop 36 who are in the path of the basketball after it exits the basketball hoop 36. The supporting bracket 42 is an L-shaped bracket with two bracket sides 46*a* and 46*b*. The bracket side 46*a* of the bracket 42 is connected to the basketball rim 38 and is perpendicular to the backboard 22. Preferably, the bracket side 46*a* is integrally molded to the basketball rim 38. In this manner, the basketball hoop 36 becomes a stronger unit which is able to withstand the additional torque forces that may be exerted by basketball players. The rim support 44 also coacts to provide additional strength to the basketball hoop 36 through direct support of the basketball rim 38. The bracket side 46*b* of the bracket 42 is attached to the backboard 22 in a parallel relationship. The bracket 42 may be attached directly to the backboard 22 or, preferably, attached to a plate 52 (FIG. 2). Situated between the bracket side 46*b* and the plate 52 is a panel 54 (FIG. 1). In the preferred embodiment, the panel 54 is made of a durable, transparent material such as glass, clear acrylic, or plastic. Alternatively, the panel 54 may be made of any other type of material provided that the material is transparent. The bracket side 46*b* of the bracket 42 is attached to the backboard 22 by screws 48 (FIG. 2) and bolts 50 (FIG. 2). In this manner, the integrity of the backboard 22 may be preserved while maintaining the basketball hoop 36 in its proper position relative to the backboard 22. In addition to the cover 34, a safety pad 56 is also situated along the bottom of the panel 54 to likewise prevent injury to the basketball players. Located adjacent to the back 32 of the backboard 22 is a target bulls eye 58.

Turning to FIG. 2, the target bulls eye 58 is more clearly illustrated. In the preferred embodiment, the target bulls eye 58 is an elongated, cylindrical member with a top portion 60 and a bottom portion 62. Preferably, the target bulls eye 58 is made of a metal material. Alternatively, the target bulls eye 58 may be made of any other type of material including but not limited to durable plastics, plexi-glass, rubber, or any other material provided that the material is strong enough to withstand normal use. As an example, normal use would include the target bulls eye 58 withstanding direct contact from the basketball. The top portion 60 and the bottom portion 62 are connected at a centerpoint 64. The top portion 60 has a length 66*a* and the bottom portion 62 has a length 66*b*. In the preferred embodiment, the length 66*a* of the top portion 60 is equal to the length 66*b* of the bottom portion 62, each being approximately four inches (4") in length. In the preferred embodiment, the entire length 66*a* of the top portion 60 is white in color and the entire length 66*b* of the bottom portion 62 is red in color. The reason for the contrasting color is to enable the basketball player to isolate the centerpoint 64 of the target bulls eye 58 when shooting and as further explained below. The inventor has found that the contrasting colors of white on red provides the best means for the basketball player to visually locate the centerpoint 64 of the target bulls eye 58. Alternatively, any other contrasting colors may be used provided the basketball player is able to physically locate the centerpoint 64 of the target bulls eye 58.

Although the target bulls eye 58 is illustrated as an elongated, cylindrical member, it can be replaced with any other form including but not limited to a cube, pyramid, rectangular solid, triangle, and/or a sphere as illustrated in FIG. 2*a*. As long as the target bulls eye 58 is a visually perceivable target, it is acceptable.

The target bulls eye 58 is connected to the plate 52 by a brace 68. In the preferred embodiment, the brace 68 is V-shaped with two members 70*a* and 70*b*. The brace 68 is preferably made of plastic. Members 70*a* and 70*b* combine to form a single end for attachment to the target bulls eye 58. In the preferred embodiment, the target bulls eye 58 is integrally molded to the brace 68. Alternatively, any other means to attach the target bulls eye 58 to the brace 68 is acceptable provided the attachment secures the target bulls eye 58 in the desired position. Each member 70*a* and 70*b* is connected to the plate 52 by extensions 72*a* and 72*b*, respectively. The extensions 72*a* and 72*b* each have a channel 74 to receive the screw 48 such that, upon tightening of the bolt 50 about the screw 48, the extensions 72*a* and 72*b* are secured against the plate 52. In the preferred embodiment, the brace 68 extends outwardly from the plate 52 at a ninety degree angle (90°) or perpendicular to the plate 52. In this manner, the brace 68 has a brace top surface 76 which is in the same horizontal plane as the bracket side 46*a* of the supporting bracket 42. In the preferred embodiment, the target bulls eye 58 is attached to the brace 68 at a ninety degree angle (90°) or perpendicular to the brace 68 and the centerpoint 64 is in the same horizontal plane as the brace top surface 76. Since the target bulls eye 58 is perpendicular to the brace 68, the target bulls eye 58 also remains parallel to the backboard 22 and the plate 52. The purpose for this relationship between the target bulls eye 58, the brace 68, the plate 52, and the supporting bracket 42 is to align the centerpoint 64 in the same horizontal plane as the basketball rim 38 of the basketball hoop 36.

With the structure of the basketball apparatus 20 previously identified, the theory behind this invention should be explained next. Typically, when shooting a backboard shot, the basketball player will focus on the basketball hoop 36 and visually estimate, from the basketball hoop 36, where the basketball should contact the backboard 22 to make a successful backboard shot. When the basketball player locates that position on the backboard 22, the basketball player will shoot the basketball along any particular trajectory and speed toward that position on the backboard 22. If the basketball player is accurate, the basketball will engage the backboard 22 at the desired position. When the basketball engages the backboard 22, it will be at a particular angle of incidence to the backboard 22. As the backboard 22 is a stable, non-moving surface, the basketball will bounce off or reflect from the backboard 22 at an angle of reflection which is the same as the angle of incidence that it engaged the backboard 22. This position on the backboard 22 is referred to as a perfect reflection point 96. The basketball will bounce or reflect at this angle of reflection and send the basketball directly into the basketball hoop 36 for a successful backboard shot.

In Applicant's invention, the basketball player neither focuses on the basketball hoop 36 nor estimates a position on the backboard 22 to shoot the basketball. Rather, the basketball player focuses solely on the target bulls eye 58 and, specifically, looks for the centerpoint 64 of the target bulls eye 58. Upon isolating the centerpoint 64, the basketball player shoots the basketball along any particular trajectory and speed toward the centerpoint 64. If the backboard 22 did not exist, the basketball would continue forward along that trajectory and directly hit the centerpoint 64 of the target bulls eye 58. Since the backboard 22 does exist, the basketball will engage the backboard 22 and then bounce off the backboard 22, as described above, into the basketball hoop 36. Thus, in Applicant's invention, the basketball player may disregard the basketball hoop 36 and the backboard 22 completely and, instead, rely solely upon the target bulls eye 58 and the centerpoint 64 to shoot his or her successful backboard shots. Also, the use of the target bulls eye 58 in this manner is effective from any position on the basketball court. Since the basketball player must isolate the centerpoint 64 of the target bulls eye 58 to successfully shoot backboard shots, the physical location of the centerpoint 64 of the target bulls eye 58 with respect to the backboard 22 is essential to this invention.

Referring to FIG. 3, the location of the target bulls eye 58 and the centerpoint 64 are more fully illustrated. The backboard 22 is situated at a supporting bracket length 78 from the basketball hoop 36. The supporting bracket length 78 of a typical supporting bracket 42 is approximately five inches (5"). The basketball rim 38 has a radius 80 to a basketball rim center 82. A typical basketball rim 38 has a radius 80 of approximately nine inches (9"). The distance from the front 30 of the backboard 22 to the basketball rim center 82 is the total of the supporting bracket length 78 (i.e., five inches) and the radius 80 (i.e., nine inches) which totals approximately fourteen inches (14"). Assume that located on the opposite side of the backboard 22 is a virtual supporting bracket 84 (shown by the phantom line) and a virtual basketball hoop 86 (shown by the phantom line). Also assume that the virtual supporting bracket 84 has the same length as the supporting bracket length 78 and that the virtual basketball hoop 86 has the same radius as the radius 80. A virtual basketball rim center 88 would, thus, also be located a rim center distance 91 of fourteen inches (14") from the back 32 of the backboard 22.

Given the basketball hoop 38, in the front 30 of the backboard 22, and the virtual basketball hoop 86, in the back 32 of the backboard 22, if a basketball player shoots a basketball toward the front 30 of the backboard 22, the basketball will engage the backboard 22 at some location along the backboard 22. If the basketball is traveling along trajectory A and the backboard 22 does not exist, the basketball will continue along trajectory A and enter the virtual basketball hoop 86 directly at the virtual basketball rim center 88. Since the backboard 22 does exist, the basketball will engage the backboard 22 at an angle of incidence 154. As the basketball will bounce off or reflect from the backboard 22 at an angle of reflection 156 which is equal and opposite to the angle of incidence 154, the basketball will travel along trajectory B and enter the basketball hoop 36 directly at the basketball rim center 82. This type of backboard shot is referred to as the "perfect basketball shot". Depending upon the location of the basketball player on the court, the trajectory and speed of the basketball 94 towards the backboard 22 will change accordingly but, in each position, the perfect basketball shot will always be realized if the basketball is on a trajectory to directly hit the virtual basketball rim center 88 of the virtual basketball hoop 86.

However, since the basketball 94 has a radius 98, it is actually the exterior surface of the basketball 94 and, therefore, not the basketball center 100, that engages the backboard 22. So, to achieve the perfect basketball backboard shot, the target bulls eye 58 and the centerpoint 64 cannot be positioned at the virtual basketball rim center, but must be positioned to account for the basketball center 100 of the basketball 94. A typical basketball 94 has a radius 98 which is approximately four and one-half inches (4½"). This results in the basketball center 100 being located approximately four and one-half inches (4½") from the front 30 of the backboard 22 or, in other words, located at reflection plane 158. The basketball rim center 82 is then located at a new distance 160 from the reflection plane 158. The new distance 160 is equal to the supporting bracket length 78 (i.e., five inches) plus the radius 80 of the basketball hoop 36 (i.e., nine inches) minus the radius 98 of the basketball 94 (i.e., four and one-half inches) or approximately (5"+9"−4½") which equals nine and one-half inches (9½"). Since, under the theory explained above, the virtual basketball rim center 88 is required to be at the same location of the basketball rim center 82, the virtual basketball rim center 88 needs to be placed at nine and one-half inches (9½") behind the reflection plane 158. As the radius 98 is four and one-half inches (4½"), the virtual basketball rim center 88 is to be placed at a distance 90 (i.e., five inches (5")) from the back 32 of the backboard 22. Accordingly, in the preferred embodiment, the target bulls eye 58 and the centerpoint 64 must be located at the distance 90 from the back 32 of the backboard 22. Now, when the basketball player looks for the centerpoint 64 of the target bulls eye 58 and, upon isolating the centerpoint 64, shoots the basketball along a trajectory C toward the centerpoint 64, the basketball 94 will still engage the backboard 22 at perfect reflection point 96 and then bounce off or reflect from the backboard 22 along trajectory D directly into the basketball hoop 36 at the basketball rim center 82 to achieve the "perfect basketball shot."

While the exact dimensions of the supporting bracket 42, the basketball hoop 36, and the basketball 94 are quantified, if any of these dimensions were increased or decreased, the location of the target bulls eye 58 and the centerpoint 64 would correspondingly likewise increase or decrease in accordance with the theories of Applicant's invention to maintain the perfect basketball shot.

FIGS. 4–6 further illustrate different views of the basketball 94 engaging the perfect reflection point 96 on the backboard 22 to enter the basketball rim 38 at the basketball rim center 82 to achieve the perfect basketball shot. In each instance, to obtain the perfect reflection point 96 and achieve the perfect basketball shot, the basketball 94 must be on a trajectory 102 to hit the centerpoint 64 (FIG. 6) of the target bulls eye 58. The trajectory 102 is any path that the basketball 94 takes to hit the centerpoint 64. Accordingly, from any position on the basketball court (not illustrated), the basketball player may use an infinite number of different trajectories 102 that would hit the centerpoint 64 with the basketball 94. For each different trajectory 102, there will be a different perfect reflection point 96 on the backboard 22 corresponding to the angle of incidence and the angle of reflection to produce the perfect basketball shot.

In an alternate or second embodiment, if the backboard 22 is not adaptable to the target bulls eye 58 described above, a reflective alternate embodiment described in FIGS. 7–11 may be used. Referring to FIG. 7, an L-shaped member 104 is affixed to the bracket side 46*a* of the supporting bracket 42. In the preferred embodiment, the supporting bracket 42 and the panel 54 are made of a reflective material such as a mirror. Alternatively, the supporting bracket 42 and the panel 54 may be made of chrome or any other type of material provided that the material has a reflective surface. In this manner and depending upon the location of the basketball player on the court, the L-shaped member 104 reflects off either the supporting bracket 42 or the panel 54 to produce a reflective target bulls eye 106 which is used to achieve the perfect basketball shot in exactly the same manner as the target bulls eye 58 in the original embodiment. The reflective target bulls eye 106 is the image from the L-shaped member 104 that is reflected into bracket side 46*b* of the supporting bracket 42 and/or the panel 54 to produce an actual reflection in the supporting bracket 42 and/or the panel 54 which is referred to as and located at the reflective target bulls eye 106. The reflective target bulls eye 106 is more fully illustrated in FIG. 8.

In FIG. 8, the L-shaped member 104 is preferably made of transparent plastic. The L-shaped member 104 has three sides: a member top 112, a member front 114, and a member back 116. In the preferred embodiment, the member top 112 is situated at a ninety degree (90°) angle with respect to the member back 116 and the member front 114 is situated at a forty-five degree (45°) angle with respect to the member top 112 and the member back 116. Alternatively, the L-shaped member 104 does not need the member front 114 to produce the reflective target bulls eye 106 as the aspects of this embodiment only require the combination of the member top 112 and the member back 116. The member front 114 is useful for stability and for placing the L-shaped member 104 in position on the supporting bracket 42 as described in FIG. 10. The member top 112 is a flat surface which has a member top exterior side 162 that is affixed to the bracket side 46*a* of the supporting bracket 42 (FIG. 11) and a member top interior side 164 that faces toward the basketball court. The member top interior side 164 of the member top 112 is divided into three sections 118, 120, and 122 (FIG. 9). Sections 120 and 122 are each circles with section 120 defining an outer ring and section 122 defining an inner ring located within the outer ring of section 120. In the preferred embodiment, section 120 is white in color and section 122 is red in color. In this manner, the contrasting color scheme between section 120 and section 122 enables the basketball player to isolate section 122 and, more particularly, estimate a reflective centerpoint 124 of the reflective target bulls eye 106. The reflective centerpoint 124 acts in the same manner as the centerpoint 64 for the target bulls eye 58. Preferably, section 118 is a color, such as blue or any other color, that does not distract from enabling the basketball player to visually locate the reflective centerpoint 124 of the reflective target bulls eye 106.

The member back 116 is also divided into a member back exterior side 166 and a member back interior side 168 that faces the bracket side 46*b* of the supporting bracket 42. In the preferred embodiment, the member back exterior side 166 of the member back 116 is the same orange color as the basketball rim 38. The reason that the member back exterior side 166 is the same color as the basketball rim 38 is to camouflage the L-shaped member 104 from the basketball players and, thereby, prevent the L-shaped member 104 from distracting the basketball players from visually isolating the reflective target bulls eye 106. In the preferred embodiment, located on the member back interior side 168 of the member back 116 is a mirrored surface.

The combination of the member top interior side 164, as illustrated in FIG. 9, and the mirrored surface of the member back interior side 168 coact to produce the reflected image into the bracket side 46*a* of the supporting bracket and/or the panel 54. The reflective centerpoint 124 of section 122 of the inner circle abuts against the member back interior side 168 of the member back 116. In the preferred embodiment, section 122 of the inner circle is a half circle. Section 120 of the outer circle and section 118 are correspondingly aligned with the member back interior side 168 of the member back 116. In use, the half circle created by section 122 and abutted against the mirrored surface of the member back 116 reflects the image of an entire circle as the mirrored surface produces the other half of the circle in the reflection. The remaining sections 120 and 118 are likewise reflected along with the section 122. This combined image from the L-shaped member 104 is reflected into the bracket side 46*b* of the supporting bracket 42 and the panel 54. As the bracket side 46*a* and the panel 54 are reflective surfaces, the image is received and displaced a depth 110 from the bracket side 46*b* and the panel 54. This reflected image forms the reflective target bulls eye 106.

The L-shaped member 104 is located a member distance 108 from the bracket side 46*b* of the supporting bracket 42. The reflective target bulls eye 106 is displaced by the supporting bracket 42 and/or the panel 54 the depth 110. In the preferred embodiment, the member distance 108 is equal to the depth 110 and enables the depth 110 to be approximately equal to the distance 90 (FIG. 3) such that the reflective target bulls eye 106 is in the same location as the target bulls eye 58. As the reflective target bulls eye 106 is in the same location as the target bulls eye 58, the reflective target bulls eye 106 and the reflective centerpoint 124 can then be used, in the same manner as the original embodiment, to achieve the same perfect basketball shot.

Referring to FIG. 9, the member top 112 of the L-shaped member 104 is more clearly illustrated. The inner circle of section 122 has an inner diameter 126 and the outer circle of section 120 has an outer diameter 128. Preferably, the inner diameter 126 is approximately one half of an inch (0.5") and the outer diameter 128 is approximately one inch (1.0"). In the preferred embodiment, the inner diameter 126 of section 122 and the outer diameter 128 of section 120 are of sufficient diameter for the reflective target bulls eye 106 to be visible by the basketball player from any location on the basketball court. The L-shaped member 104 has a member length 130 which is also the same length of section 118. In the preferred embodiment, the member length 130 is approximately two inches (2.0"). Alternatively, section 118 may be removed and the member length 130 may be equal to the outer diameter 128 of section 120 provided the reflective target bulls eye 106 and the reflective centerpoint 124 continue to be visible by the basketball player from any location on the basketball court.

Referring to FIG. 10, the L-shaped member 104 is affixed into position on bracket side 46*a* of the supporting bracket 42 or, in other words, at member distance 108, using a guide template 132. The guide template 132 consists of a wedge 134, an arm 136, and a column 138. The wedge 134 and the arm 136 are affixed perpendicular to one another to form a T-shaped bracket. The wedge 134 has an inset 140 to receive bracket side 46*b* of bracket 42 to secure the guide template 132 to the supporting bracket 42. The arm 136 extends outwardly from the wedge 134 an arm distance 142. At the end of the arm 136 is located a shoulder 144. The column 138 is situated at the end of and perpendicular to the arm 136 abutting against the shoulder 144. The column 138 has a channel 146 to enable the column 138 to move in the direction of Arrow A to place the L-shaped member 104 into position. The column 138 contains a ledge 148 to receive and hold the L-shaped member 104 in proper alignment as the column 138 is moved toward the supporting bracket 42 to attach the L-shaped member 104 to the bracket side 46*a*. Once the column 138 reaches the supporting bracket 42, the L-shaped member 104 is adhered to the bracket side 46*a* of the supporting bracket 42 and the guide template 132 is removed.

Any means is contemplated to adhere the L-shaped member 104 to the supporting bracket 42. In the preferred embodiment and as illustrated in FIG. 11, the member top exterior side 162 of the member top 112 contains layers 150 and 152. In the preferred embodiment, layer 150 is a sticky substance or bonding agent such as an adhesive and layer 152 is a different sticky substance or bonding agent such as glue. Also, in the preferred embodiment, the sticky substance or bonding agent is clear in color to alleviate any reflection of the sticky substance or bonding agent from being reflected through the transparent plastic of the L-shaped member 104 and disrupt the reflective target bulls eye 106. Alternatively, any type of sticky substance or bonding agent is acceptable provided that the sticky substance or bonding agent adheres to the supporting bracket 42 and secures the L-shaped member 104 into the proper position. The L-shaped member 104 may also be made of any type of material provided the material adheres to the sticky substance or bonding agent.

Thus, there has been provided a basketball apparatus that teaches basketball players to improve their shooting accuracy using the target bulls eye or reflective target bulls eye when shooting backboard shots from any location on the basketball court. While the invention has been described in conjunction with a specific embodiment, it is evident that many alternatives, modifications and variations will be apparent to those skilled in the art in light of the foregoing description. Accordingly, it in intended to embrace all such alternatives, modifications and variations as fall within the spirit and scope of the appended claims.

What is claimed is:

1. A basketball apparatus for practicing shooting backboard shots, comprising:

a backboard having a front side and a back side;

a fixed reflective surface attached on at least a portion of the front side of the backboard;

a basketball hoop;

means for affixing the basketball hoop to the front side of the backboard;

a member located between the basketball hoop and the front side of the backboard and affixed to the means for affixing the basketball hoop to the front side of the backboard;

a target affixed to the member; and whereby the target produces a reflective target bulls eye in the reflective surface of the backboard for providing a target for shooting backboard shots, a basketball projected into a trajectory on the front side of the backboard to hit the reflective target bulls eye located on the reflective surface and, while in that trajectory, the basketball engages and bounces off the front side of the backboard for entry into the basketball hoop located on the front side of the backboard.

2. The basketball apparatus of claim 1 wherein the means for affixing the basketball hoop to the front side of the backboard is a supporting bracket.

3. The basketball apparatus of claim 2 wherein the target is located at a target distance from the front side of the backboard of approximately a supporting bracket length plus a radius of the basketball hoop minus a diameter of a basketball.

4. The basketball apparatus of claim 3 wherein the target is located approximately five inches from the front side of the backboard.

5. The basketball apparatus of claim 3 wherein the reflective target bulls eye is located a reflective target distance from the back side of the backboard which is approximately equal to the target distance.

6. A basketball apparatus for practicing shooting backboard shots, comprising:

a backboard having a front side and a back side;

a fixed reflective surface attached on at least a portion of the front side of the backboard;

a basketball hoop;

a supporting bracket having a first bracket side and a second bracket side, the first bracket side being affixed to the basketball hoop and the second bracket side being affixed to the front side of the backboard and forming part of the reflective surface, a member having two exterior surfaces and two interior surfaces, the first interior surface being disposed parallel to the first bracket side and displaying a target, the second interior surface enabling the reflection of the target toward the reflective surface, the reflective surface receiving the reflection of the target from the second interior surface for producing a reflective target bulls eye;

means for affixing the member to the first bracket side of the supporting bracket; and whereby the reflective target bulls eye providing a target for shooting backboard shots, a basketball projected into a trajectory on the front side of the backboard to hit the reflective target bulls eye located on the reflective surface and, while in that trajectory, the basketball engages and bounces off the front side of the backboard for entry into the basketball hoop located on the front side of the backboard.

7. The basketball apparatus of claim 6 wherein the reflective target bulls eye is located a reflective target distance which is approximately located a supporting bracket length plus a radius of the basketball hoop minus a radius of a basketball as measured from a reflection plane, the reflection plane being located at a reflection plane distance which is approximately the radius of the basketball from the front side of the backboard, the target being located a target distance from the front side of the backboard which is approximately equal to the reflective target distance minus the radius of the basketball.

* * * * *